United States Patent [19]

Golub et al.

[11] 4,446,343

[45] May 1, 1984

[54] SWITCH MECHANISM FOR TRANSFORMER

[75] Inventors: Gregory J. Golub; Albert M. Jenkins, both of Athens, Ga.

[73] Assignee: Westinghouse Electric Corp., Pittsburgh, Pa.

[21] Appl. No.: 417,964

[22] Filed: Sep. 14, 1982

[51] Int. Cl.[3] ..... H01H 3/00; H01H 19/00; H01H 21/00

[52] U.S. Cl. ..... 200/11 TC

[58] Field of Search ..... 200/11 TC, 17, 18, 63 A, 200/70

[56] References Cited

U.S. PATENT DOCUMENTS

| | | | |
|---|---|---|---|
| 3,213,223 | 10/1965 | Sickler . | |
| 3,461,259 | 8/1969 | Leonard et al. | 200/63 A |
| 3,462,611 | 8/1969 | McMorris . | |
| 3,590,183 | 6/1971 | Leonard | 200/70 X |
| 3,903,384 | 9/1975 | De Visser et al. . | |
| 4,013,847 | 3/1977 | Guidosh | 200/11 TC |
| 4,035,717 | 7/1977 | Guidosh | 200/11 TC X |
| 4,138,602 | 2/1979 | Eley | 200/70 X |

*Primary Examiner*—J. R. Scott

*Attorney, Agent, or Firm*—L. P. Johns

[57] ABSTRACT

A circuit breaker mechanism for use with a transformer characterized by a pair of open-close load break switches operated by a single handle through two four-bar linkages for operating the switches simultaneously between three- or four-position combinations.

4 Claims, 10 Drawing Figures

73
83
3
87
91
85
93
89
81
71
69
67
65
17
15
51
61
63
49
5
7
13
23
9
53
55
25
77
78
31
33
43
19
21
II
III
1
2

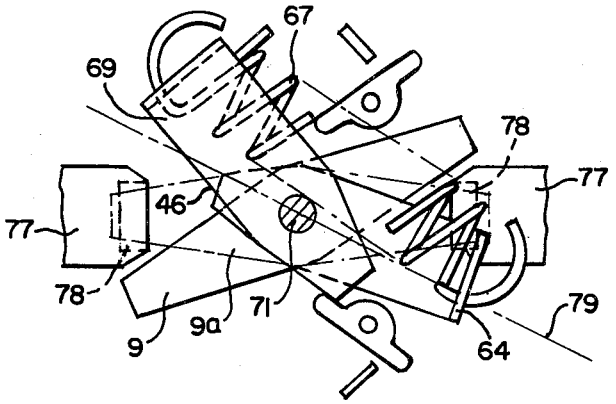
FIG.3.
FIG.2.
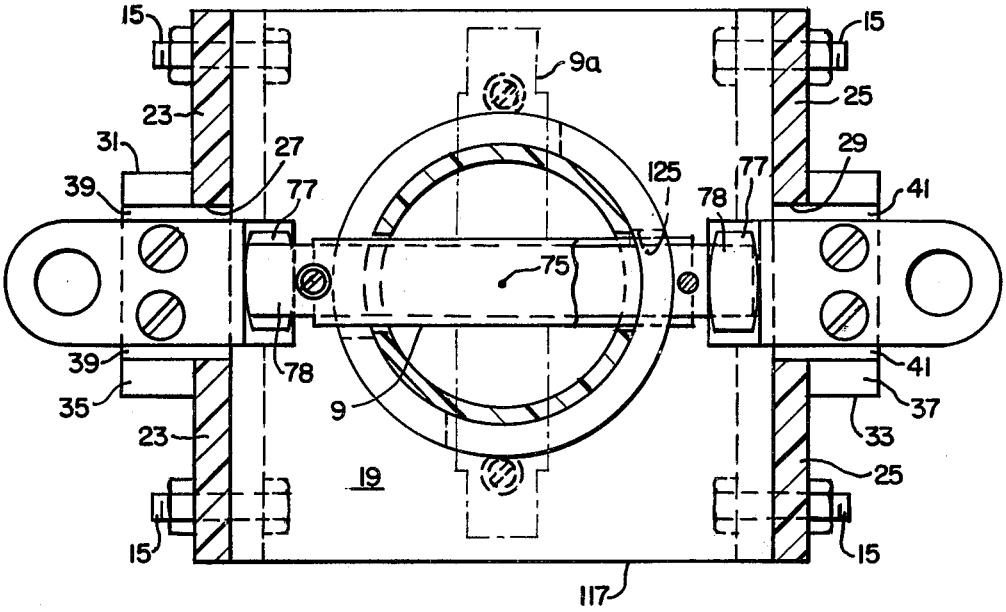

SWITCH MECHANISM FOR TRANSFORMER

CROSS REFERENCE TO RELATED APPLICATION

This application is related to the application Ser. No. 382,251, filed May 26, 1982, now U.S. Pat. No. 4,412,116 in the name of Gregory J. Golub, which application is assigned to the same assignee as the present application.

BACKGROUND OF THE INVENTION

1. Field of the Invention

This invention relates to an externally operated mechanism for a distribution transformer, and more particularly, it pertains to a pair of open-close load break switches for accomplishing three- or four-position feed conditions to a pad mounted distribution transformer.

2. Description of the Prior Art

In order to provide loop feed capability to pad mounted distribution transformers using simple open-close switches, the so-called "quick-make and quick break" type of switch is particularly suitable for the switch contacts immersed in transformer oil. Such switches are disclosed in U.S. Pat. Nos. 3,461,259 and 3,590,183 and are provided with an overcenter spring mechanism for rotatably moving contact structures for opening and closing circuits. The rotatable moving contact structure comprises a rotatable contact carriage carrying parts of contact fingers extending outwardly from the rotatable carriage and making separable engagement with corresponding stationary-spaced blade-shaped contacts.

Formerly, where a transformer was fed from either of two supply lines, such as lines A and B, two open-close switches were used to obtain four switch positions; namely, both switches open, both switches closed, one switch open and the other closed, and the one switch closed and the other open. Where, however, one line, such as line B, is converted to ground, it is necessary to switch between open, close, and ground positions, for which the conventional switch has been inoperative.

Accordingly, a need exists for a switch mechanism which is operable between four positions for a two line supply and three positions for a one line supply with the other line grounded.

SUMMARY OF THE INVENTION

It is has been found in accordance with this invention that three- or four-position feeds to a distribution transformer may be provided which comprises a switching device between two electrical supply lines for use with electrical inductive apparatus, a pair of open-close switches electrically connected to the apparatus for three-and four-position switching, each switch having an operating shaft; a movable contact structure on the shaft, and spaced stationary contact structures disposed on the switch for simultaneous open-close switching; the operating shafts having separate shaft portions; an operating handle connected to the separate shaft portions; linkage means coupled between the operating shaft portions and the handle to provide (a) four-position switching including transformer closed through both switches, transformer closed through one switch, transformer closed through the other switch, transformer open through both switches, or (b) three-position switching including transformer grounded, closed, or open, when one of the electrical supply lines is grounded.

The advantage of the device of this invention is that it provides an externally operated mechanism used in conjunction with two open-close load break switches to accomplish three-or four-position feed to a pad mounted distribution transformer, and utilizes two four-bar linkages simultaneously to operate two separate open-close switches. The two switches and operating mechanism combine to provide a unique four-position switch.

BRIEF DESCRIPTION OF THE DRAWINGS

FIG. 2 is a horizontal sectional view taken on the line II—II of FIG. 1;

FIG. 3 is a horizontal sectional view taken on the line III—III of FIG. 1;

DESCRIPTION OF THE PREFERRED EMBODIMENT

Figure 1:
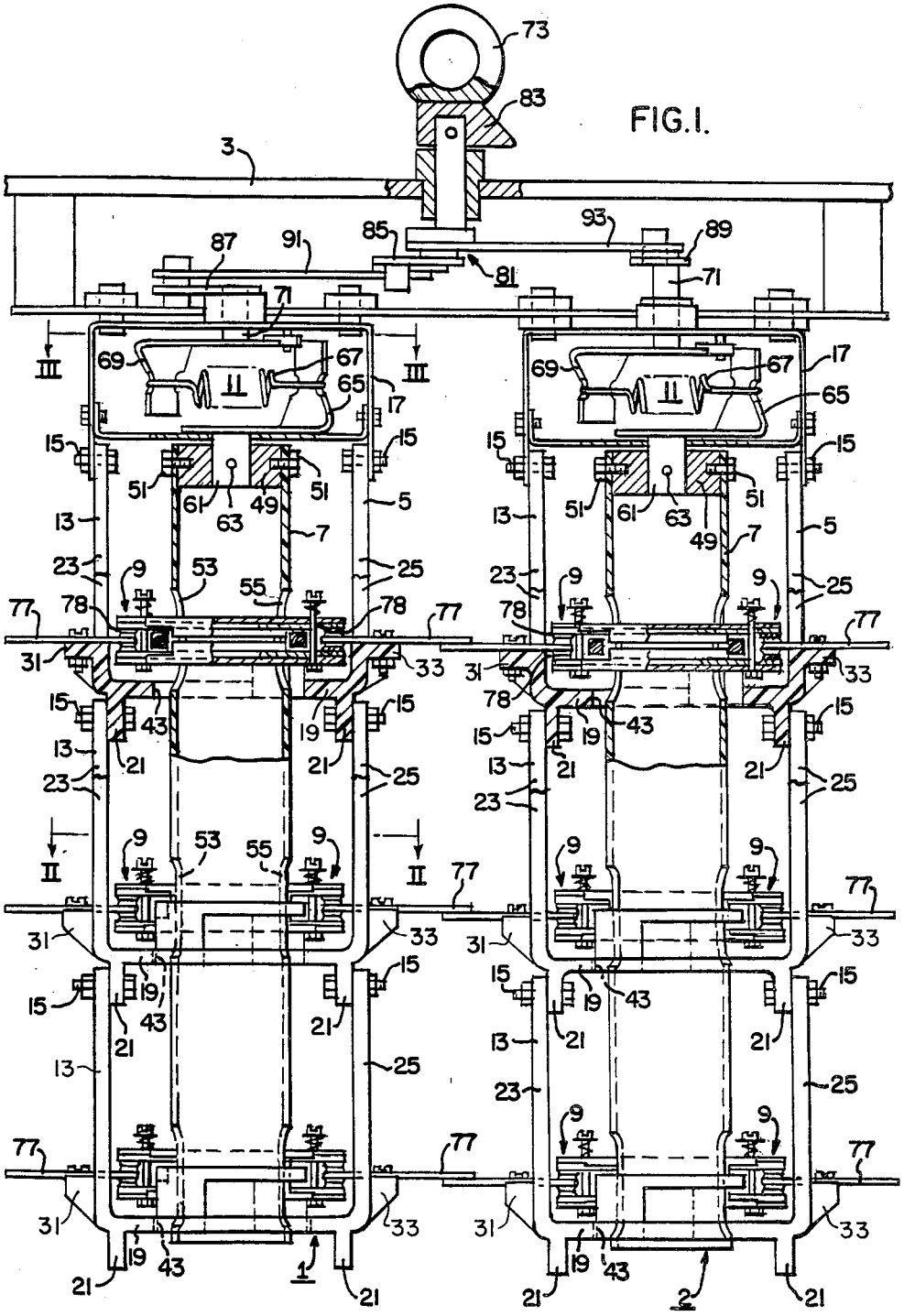
FIG. 1 is an elevational view, partly in section, of a pair of switch units in closed circuit positions.

In FIG. 1 a pair of circuit breakers or switches are generally indicated at 1 and 2 and are typically used in conjunction with a pad mounted or submersible-type transformer which is provided for underground distribution circuits for residential neighborhoods. Generally, a submersible-type transformer is disclosed in U.S. Pat. No. 4,361,259, issued Aug. 12, 1969 to M. G. Leonard et al., which comprises an underground vault in which a distribution transformer is located within a cylindrical housing. The transformer comprises a high voltage winding and a low voltage secondary winding which are inductively coupled.

Although the switches 1 and 2 are adapted for use with one or more phases, a three phase mode is disclosed for purposes of illustration. In FIG. 1 the switches 1 and 2 are shown in closed circuit positions. Inasmuch as both switches 1 and 2 are identical in construction and operation, the following description pertains to both switches.

The switches are mounted on an upper cover 3 of the transformer tank and comprise an outer housing 5, a tublar shaft 7, a plurality of vertically spaced pairs of contact arms generally indicated at 9, and an overcenter spring mechanism 11. The housing 5 is comprised of three separable U-shaped supporting members or decks 13. Adjacent decks 13 are secured together by nut and bolt assemblies 15, and the uppermost deck is similarly secured to a box-like frame 17 in which the overcenter spring mechanism 11 is disposed.

Each deck 13 (FIGS. 1, 2) is a U-shaped member comprised of a dielectric material that is molded to include a base 19 having a pair of spaced mounting flanges 21, and a pair of oppositely disposed upright sides 23, 25. The upright sides 23, 25 include slots 27, 29, respectively. Outturned flanges 31, 33 are provided at the lower end of the slots 27, 29 and are in planar alignment. Each flange 31, 33 includes a pair of similar spaced ribs 39, 41 (FIG. 2). The base has a hole 43 through which the shaft 7 extends.

The tubular shaft 7 (FIG. 1) is mounted by bolts 51 onto the upper end of an end plug 49. At vertically spaced intervals, pairs of openings 53, 55 are disposed along the shaft and aligned with each other. As shown in FIG. 1, the shaft 7 is disposed centrally of the outer housing 5 and extends through the aligned holes 43 which retain the shaft in alignment with a shaft 61 which is rigidly secured in the plug 49 by a pin 63.

The upper end of the shaft 61 is secured to a spring arm 65 of the overcenter spring mechanism 11. A Spring 67 extends between the driven spring arm 65 and a driving crank arm 69 which is secured to the lower end of a shaft portion 71 which actuates the crank arm 69.

The overcenter spring mechanism 11 comprises an externally-disposed manually-operable handle 73 which affects rotative opening and closing of the driving crank arm 69. To open or close the circuits, the contact arm 9, which is pivoted at 75 (FIG. 2), is rotated between the solid line 9 and broken line **9*a* positions, whereby the circuit is moved between stationary contacts 77 and movable contacts 78 at opposite end portions of the contact arm 9. For that purpose the overcenter spring 67 (FIG. 3) provides a quick-make and quick-break action when its line of action passes through the centerline 79** of the device in a conventional overcenter action.

In accordance with this invention the switches 5 (FIG. 1) include linkage means 81 which are coupled between the operating shaft portions 71 of both switches 1 and a crank shaft 83 which extends through the cover 3 and on which the handle 73 is fixedly mounted. The linkage means 81 (FIG. 5) comprises a crank arm 85 fixedly mounted on the crank shaft 83, rocker arms 87, 89 fixedly mounted on each shaft portion 71, similar connecting links 91, 93, and a crank 95. The connecting link 91 extends between crank arm 85 and rocker arm 87 to which the link 91 is pivotally secured by similar pivot pins 96 and 97. The connecting link 93 extends between the rocker arm 89 and the crank link 95 to which the link 93 is pivotally mounted by pivot pins 98 and 99. The crank are 95 is fixedly attached to pivot pin 97 which is fixedly attached to crank arm 85, whereby the crank arm 85 and crank link 95 are disposed at a fixed angle, such as 45°. During operation of the linkage means 81, the pivot pins 97, 99 move in a circle of rotation 101 (FIG. 4) as the switches 1 and 2 are successively moved between various open and closed switch combinations.

Figure 4:
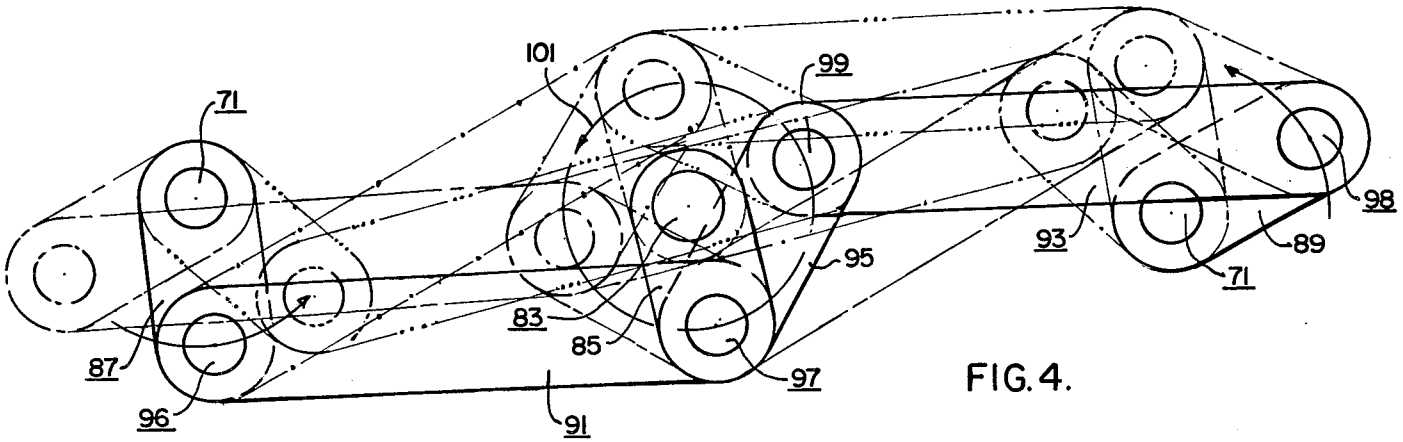
FIG. 4 is a plan view of the linkage means coupled between the operating shafts and the manual handle showing the four operational positions thereof.
Figure 5:
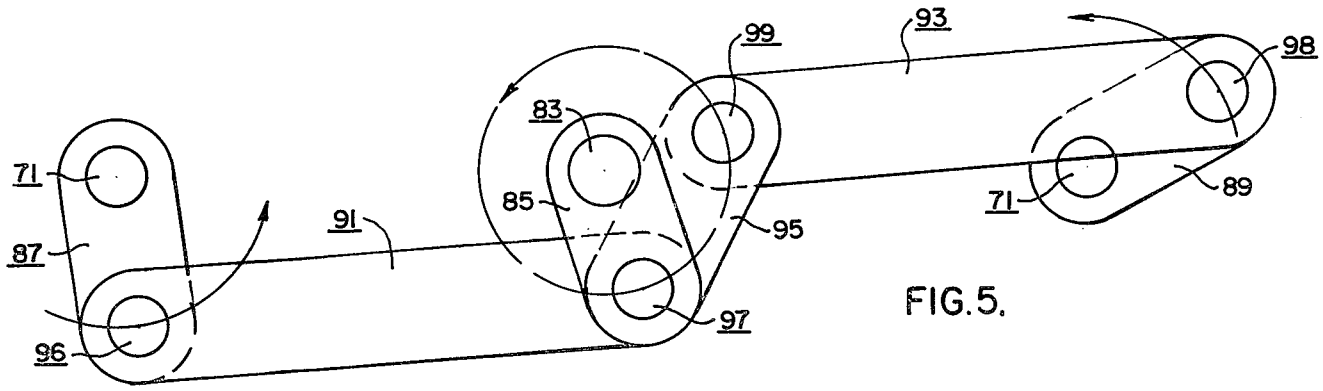
FIG. 5 is a plan view of the linkage means in the position where both switches are closed.
Figure 6:
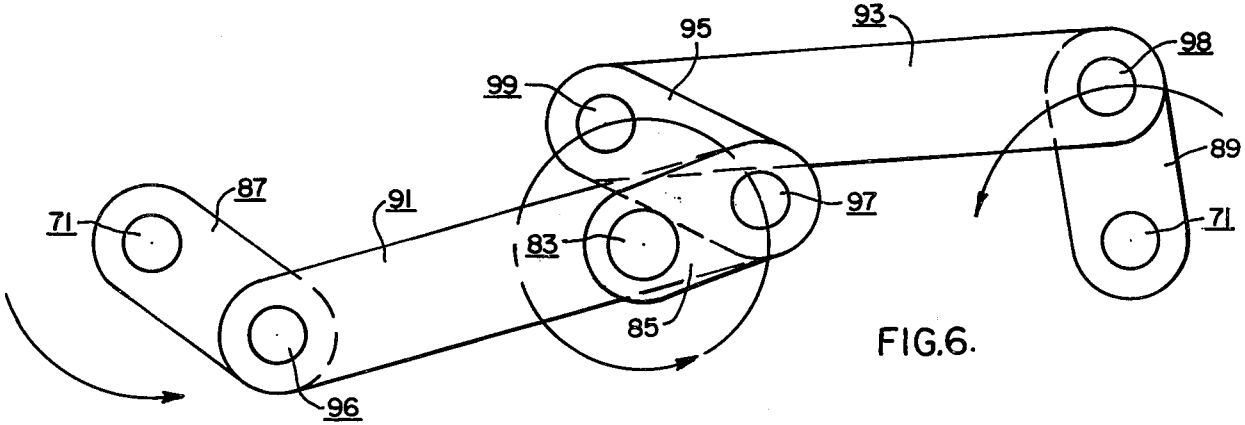
FIG. 6 is a plan view showing the linkage means in the position in which one switch is closed and one switch open.
Figure 7:
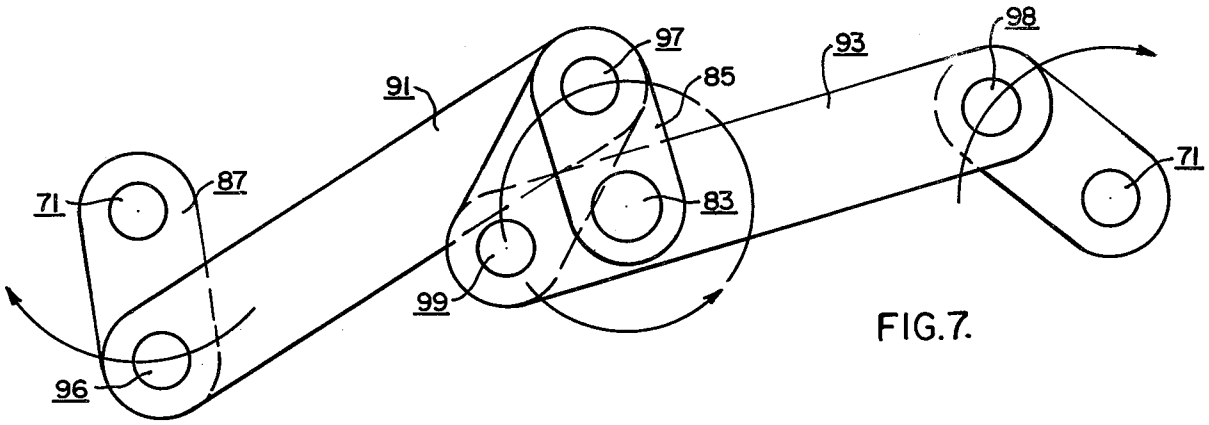
FIG. 7 is an elevational plan view of the linkage means in the position of both switches being open.
Figure 8:
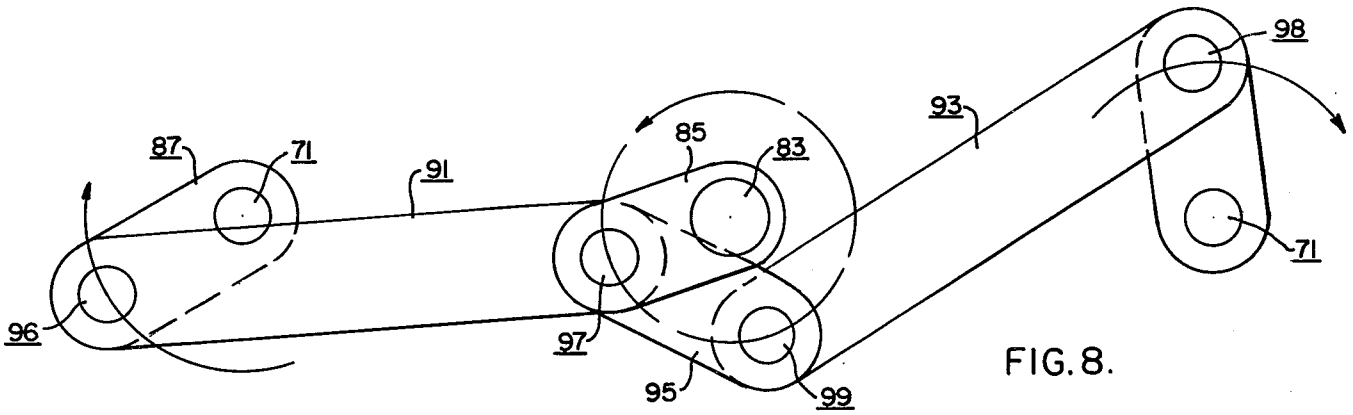
FIG. 8 is a plan view of the linkage means in which another switch is open and the remaining switch is closed.

In FIG. 4, four switch positions are indicated by either solid line or broken line positions of the several parts of the linkage means including parts 83–99. The four switch positions include both switches 1, 2 closed, one switch closed and the other open, the other switch closed and the one switch opened, and both switches open. The position of the linkage means in FIG. 5 corresponds to both switches 1 and 2 being in closed circuit condition as indicated (FIG. 2) in the solid line position of the contact arm 9. The position of the linkage means in FIG. 6 corresponds to switch 1 being open and switch 2 being closed. In FIG. 7 the linkage means corresponds to the switch condition in which switches 1 and 2 are open. Finally, the position of the linkage means in FIG. 8 corresponds to the condition wherein switch 1 is closed and switch 2 is open.

During each operation of the linkage means the overcenter spring 11 for one switch moves through the overcenter position to either open or close the corresponding switch contacts. However, for the same operation, the overcenter spring 11 of the other switch is arrested in the extended condition just prior to moving through the overcenter line 79 (FIG. 3). Accordingly, one switch may be moved from either open or closed position while the other switch remains in either open or closed condition. Accordingly, the four positions are available for the switching device involving switches 1 and 2.

Figure 9:
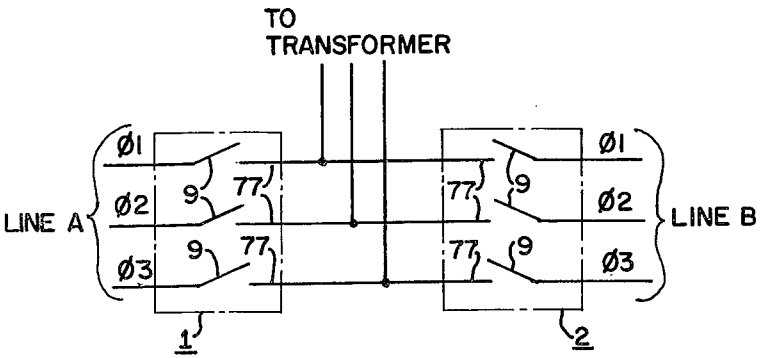
FIG. 9 is an electrical schematic diagram of the four-position switch connected to two current sources, whereby four switch positions are available.

As shown in FIG. 9, switch 1 is connected to a three phase supply line A and switch 2 is connected to a three phase supply line B. As a result the transformer may be used with either or both lines A and B.

Figure 10:
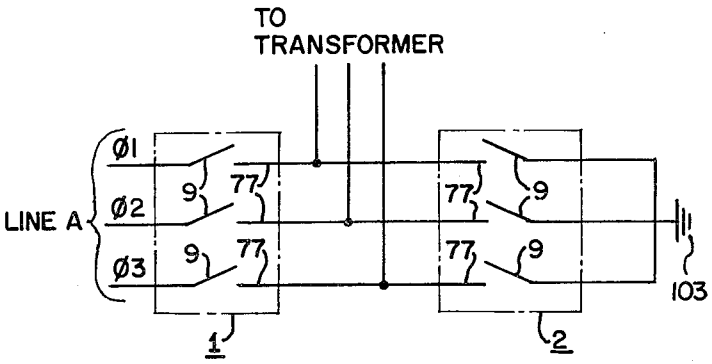
FIG. 10 is an electrical schematic diagram showing one switch connected to ground whereby a three-position switch is provided.

In the alternative where one line is grounded, such as at 103 (FIG. 10), the transformer may be operated from line A with three position switching including the transformer grounded, closed, or open.

In conclusion, the switch mechanism combines two four-bar linkages and operates the linkages simultaneously with one operating shaft to obtain either three- or four-position switching.

What is claimed is:

1. A switching device between two electrical supply lines for use with electrical inductive apparatus, comprising:

a tank having a side wall for containing electrical inductive apparatus;

a pair of open-close switches mounted on the side wall and electrically connected to said apparatus to provide three- and four-position switching;

each switch having an operating shaft, a movable contact structure on the shaft, and spaced stationary contact structures disposed on the switch for simultaneous open-close switching;

the operating shafts having separate shaft portions;

an operating handle external of the tank and connected to the separate shaft portions;

linkage means coupled between the operating shaft portions and the handle to provide (a) four-position switching including (1) transformer closed through both switches, (2) transformer closed through the one switch, (3) transformer closed through the other switch, (4) transformer open through both switches, or (b) three-position switching including transformer grounded, closed, or open, when one of the electrical supply lines is grounded;

means for connecting the operating handle to the linkage means and include a crank shaft extending through the side wall;

a crank arm fixedly mounted on the crank shaft;

a crank link fixedly mounted on the crank arm;

a rocker arm mounted on each operating shaft portion;

and a connecting link connected between the crank arm and each of the rocker arms.

2. The device of claim 1 in which a link is connected between the first crank arm and one of the connecting arms.

3. The device of claim 2 in which each operating shaft includes a driven rocker member fixedly secured thereon, each separate shaft portion having a drive crank member, and an overcenter tension spring interconnecting the drive and driven crank members for snap-opening and snap-closing action.

4. The device of claim 3 in which during each operation of the operating handle the tension spring of one switch is preliminarily charged without going overcenter and the tension spring of the other switch is discharged by passing overcenter.

* * * * *